US009216488B2

(12) United States Patent
Allison

(10) Patent No.: US 9,216,488 B2
(45) Date of Patent: Dec. 22, 2015

(54) ADJUSTABLE SHARPENING APPARATUS AND METHOD FOR CUTTING IMPLEMENTS

(71) Applicant: Clay A. Allison, Santa Fe, NM (US)

(72) Inventor: Clay A. Allison, Santa Fe, NM (US)

( * ) Notice: Subject to any disclaimer, the term of this patent is extended or adjusted under 35 U.S.C. 154(b) by 322 days.

(21) Appl. No.: 13/889,393

(22) Filed: May 8, 2013

(65) Prior Publication Data

US 2014/0335765 A1 Nov. 13, 2014

(51) Int. Cl.
*B24B 3/54* (2006.01)

(52) U.S. Cl.
CPC ..... *B24B 3/54* (2013.01)

(58) Field of Classification Search
CPC ..... B24D 15/06; B24D 15/08; B24B 3/54; B24B 41/06
See application file for complete search history.

(56) References Cited

U.S. PATENT DOCUMENTS 2,127,289 A * 8/1938 Corrall et al. ..... 451/175
2,142,105 A * 1/1939 Blankner ..... 451/164
2,157,816 A * 5/1939 Carosi ..... 76/82.2
2,191,899 A * 2/1940 Primak ..... 451/175
2,259,095 A * 10/1941 Aiello, Sr. ..... 76/82.2
2,370,908 A * 3/1945 Llorens ..... 451/378
2,397,256 A * 3/1946 Foster ..... 76/82.2
4,216,627 A * 8/1980 Westrom ..... 451/175
4,217,735 A * 8/1980 McGeoch et al. ..... 451/321
4,441,279 A * 4/1984 Storm et al. ..... 451/175
4,471,951 A * 9/1984 LeVine ..... 269/3
4,512,112 A * 4/1985 LeVine ..... 451/371
4,538,382 A * 9/1985 Johannsen ..... 451/175
4,714,239 A * 12/1987 LeVine ..... 269/3
4,731,953 A * 3/1988 Owen ..... 451/163
4,777,770 A * 10/1988 LeVine ..... 451/557
5,185,958 A * 2/1993 Dale ..... 451/174
5,195,275 A * 3/1993 McLean ..... 451/175
5,363,602 A * 11/1994 Anthon et al. ..... 451/540
5,431,068 A * 7/1995 Alsch ..... 76/82
6,168,509 B1 * 1/2001 Presgrove ..... 451/552
6,579,163 B1 * 6/2003 Ross et al. ..... 451/545
7,052,385 B1 * 5/2006 Swartz ..... 451/367
7,144,310 B2 12/2006 Longbrake
7,413,504 B2 * 8/2008 Lytinas ..... 451/67

(Continued)

FOREIGN PATENT DOCUMENTS

CA 2331369 A1 * 11/1999
CA 2367189 A1 * 7/2002

(Continued)

*Primary Examiner* — Joseph J Hail
*Assistant Examiner* — Marc Carlson
(74) *Attorney, Agent, or Firm* — Ross K. Krutsinger; Mesmer & Deleault PLLC

(57) ABSTRACT

An apparatus for sharpening a cutting implement has a base, a first clamping member and a second clamping member extending above the base. The clamping members have opposite top portions, bottom portions, and vertical inside surfaces substantially parallel to a vertical plane of the cutting implement. At least one guide rod is pivotably attached to the base. The guide rod distal end extends above the base at an angle to the vertical plane. An abrasive implement holder is configured to slidably move along the at least one guide rod. The abrasive implement holder has a body and holder aperture therethrough that extends along a guide rod axis and that is sized and configured to receive the guide rod. An adjustable face plate is pivotably connected to the body and defines a second angle with the guide rod axis. Pivoting the adjustable face plate changes the second angle.

23 Claims, 13 Drawing Sheets

(56) References Cited

U.S. PATENT DOCUMENTS

| | | | | |
|---|---|---|---|---|
| 8,262,438 | B1 * | 9/2012 | Allison et al. | 451/321 |
| 2004/0077299 | A1 * | 4/2004 | Friel, Sr. | 451/344 |
| 2007/0249268 | A1 * | 10/2007 | Swartz | 451/349 |
| 2011/0159791 | A1 * | 6/2011 | Heng | 451/371 |
| 2011/0177764 | A1 * | 7/2011 | Schwartz | 451/371 |

FOREIGN PATENT DOCUMENTS

| | | | | |
|---|---|---|---|---|
| WO | WO 2004037488 | A1 * | 5/2004 | B24B 3/36 |
| WO | WO 2007048165 | A1 * | 5/2007 | |

* cited by examiner

ADJUSTABLE SHARPENING APPARATUS AND METHOD FOR CUTTING IMPLEMENTS

BACKGROUND OF THE INVENTION

1. Field of the Invention

The present invention relates generally knife sharpeners and more particularly to an adjustable sharpening apparatus for cutting implements.

2. Description of the Prior Art

Available knife sharpening systems typically include a hand-held sharpening hone or block and a clamp used to hold a knife in a fixed position. The user slides the sharpening block across the cutting edge of the knife at an angle.

U.S. Pat. No. 7,144,310 to Longbrake discloses an adjustable knife sharpener apparatus. The apparatus includes a clamping mechanism operable to secure a knife blade, and at least one adjustable guide rod coupled to the clamping mechanism to adjust a sharpening angle of the knife sharpener apparatus. The apparatus further includes a first guide rod coupled to a first clamp member, and a first infinitely adjustable guide loop coupled to the first guide rod to adjust a sharpening angle of the knife sharpener apparatus.

U.S. Pat. No. 4,512,112 to LeVine discloses a sharpener clamp construction comprising first and second clamp members having a first longitudinal axis and first and second ends, respectively. First and second jaws at the first ends of the first and second clamp members, respectively, are for clamping a knife with a second longitudinal axis extending transversely to the first longitudinal axis. The LeVine patent further discloses first and second guide member means formed integrally with and extending outwardly from the first and second clamp members, respectively, at the second end. The first and second guide member means has a plurality of apertures at different distances from the second end for receiving a guide rod attached to a sharpener stone holder.

SUMMARY OF THE INVENTION

The prior art patents lack the ability to securely fix a guide rod in an adjustable fixed position where the guide rod is coupled to a stable base with a clamping mechanism. The prior art patents also lack the ability to repeatably and verifiably control the depth and alignment of the knife blade with respect to the clamping mechanism and the sharpening blocks.

Prior art knife sharpeners are also flimsy, limited in adjustment, or have no way to sharpen a cutting edge with a consistent, repeatable angle between the hone and the blade. Prior art sharpeners also lack the ability for the user to finely-adjust or determine the sharpening angle with the desired level of accuracy. Currently-available sharpeners also lack the ability to precisely achieve a sharpening angle below ten degrees as required for Japanese knives and the like.

Further, existing sharpeners generally lack the ability to sharpen complex cutting edges, such as found on sport knives and barber's shears. Due to the complex cutting edge profile, the user resorts to guessing, becoming so adept at sharpening by hand that the process becomes somewhat precise, using an expensive professional sharpening service, or purchasing a very expensive machine designed to sharpen implements with complex cutting edge profiles.

Accordingly, a need exists for a sharpener for a variety of cutting implements and that provides controlled, adjustable, and repeatable sharpening angles from one sharpening session to the next.

It is an object of the present invention to provide an apparatus for sharpening a variety of cutting implement blades.

The present invention achieves these and other objectives by providing an apparatus for sharpening a cutting implement held in a vertical plane between first and second clamping members extending above a base. The first and second clamping members have opposite top portions and bottom portions. Vertical inside surfaces of the clamping members face each other and are substantially parallel to the vertical plane. A guide rod is pivotably attached to the base at is proximal end and has a distal end that extends above the base at an angle to the vertical plane. An abrasive implement holder is configured to slidably move along the guide rod.

In one embodiment, the abrasive implement holder has a body with a holder aperture therethrough. The holder aperture extends along a guide rod axis and is sized and configured to receive the guide rod. An adjustable face plate is pivotably connected to the body and defines a second angle with the guide rod axis, where pivoting the adjustable face plate changes the second angle.

In another embodiment, the distance between the proximal end of the guide rod and the vertical plane is adjustable. In one embodiment, the apparatus includes an angle adjustment assembly with at least one arm connected to the proximal end of a guide rod. A control gear is disposed in rotational engagement with the arm(s), where rotating the control gear changes the distance between the proximal end and the vertical plane.

In another embodiment, a universal joint is connected between the control arm and the proximal end of the at least one guide rod. In one embodiment, the universal joint is a ball-and-socket joint. In another embodiment, the universal joint has a shaft portion that threadably engages a bracket, where rotating the shaft member changes the distance between the proximal end of the guide rod and the vertical plane.

In another embodiment, a fulcrum is disposed between the first and second vertical inside surfaces. A wedge member is configured to move between the first clamping member and the second clamping member to change the gap between the top portions by pivoting the first clamping member about the fulcrum with respect to the second clamping member.

In another embodiment, the apparatus includes a straight-line clamp connected to the wedge member, where actuating the straight-line clamp moves the wedge member.

In another embodiment, the wedge member has gears for engaging a geared rotatable shaft or lever.

In another embodiment, one or both of the first vertical inside surface and the second vertical inside surface has a slot with a slot depth. The slot is sized and configured to movably engage the wedge member. In one embodiment, slot depth increases towards the first bottom portion.

In another embodiment, the angle with the vertical plane is adjustable to less than ten degrees. In another embodiment, the angle is adjustable to less than six degrees.

In another embodiment, the knife sharpener includes an inclinometer configured to display the angle with the vertical plane.

Also disclosed is a method of sharpening a cutting implement where the cutting implement is held in a vertical plane and where an abrasive element holder is slidably moved along a guide rod in frictional engagement with the cutting implement.

In one embodiment the method includes securing the cutting implement in a vertical plane between a first vertical inside surface of a first clamping member and a second vertical inside surface of a second clamping member, where the first clamping member and the second clamping member extend above a base member. A first angle is set between a guide rod and the fixed vertical plane, where the guide rod has a proximal end attached to the base member at an adjustable distance from the vertical plane. A second angle is set between the sharpening bock and the guide rod. An abrasive implement holder slidably mounted to the guide rod is moved up and down along the guide rod and in frictional engagement with the cutting implement.

In another embodiment of the method, the securing step includes advancing a wedge member between the first clamping member and the second clamping member, thereby increasing a gap between a bottom portion of the first clamping member and a bottom portion of the second clamping member and causing the top portion of the first clamping member and the top portion of the second clamping member to engage the cutting implement.

In another embodiment of the method, the first angle is set between five and fifteen degrees, between fifteen and twenty-five degrees, or between twenty-five and thirty-five degrees In another embodiment of the method, the second angle is set between zero and forty-five degrees. In another embodiment, the second angle is set between forty-five and eighty degrees.

DETAILED DESCRIPTION OF THE PREFERRED EMBODIMENT

Figure 1:
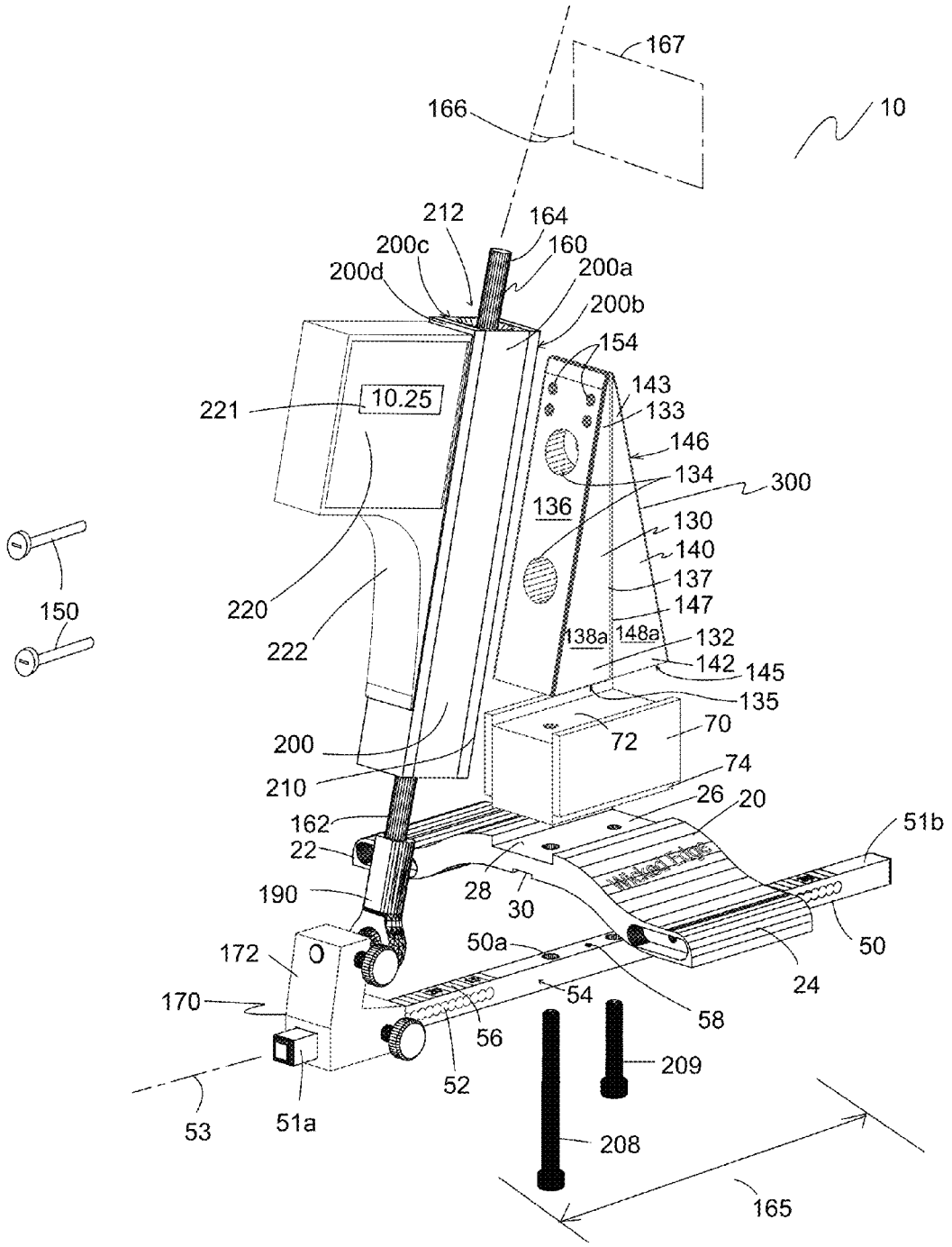
FIG. 1 is a perspective, exploded view of one embodiment of a knife sharpener of the present invention showing components of the apparatus.

The preferred embodiments of the present invention are illustrated in FIGS. 1-13. FIG. 1 shows an exploded, perspective view of one embodiment of a sharpener 10 of the present invention. Sharpener 10 has a base 20, an angle adjustment assembly 170, an optional riser block 70 connected to base 20, a clamping assembly 300, a guide rod 160, and an abrasive element holder 200 slidably mounted to guide rod 160. One embodiment of angle adjustment assembly 170, discussed in more detail below, includes a base rod 50, pivot joint 190, and bracket 172. One embodiment of clamping assembly 300 includes a first clamping member 130, a second clamping member 140, and clamping fasteners 150.

A first fastener 208 extends through aligned apertures 50*a* in base rod 50, base 20, and riser block 70. First fastener 208 extends into and engages a bottom portion 132 of first clamping member 130. A second fastener 209 extends through base rod 50 and base 20. Second fastener 209 extends into and engages riser block 70. First and second fasteners 208, 209 secure together base rod 50, base 20, riser block 70, and first clamping member 130.

In one embodiment, base 20 is a substantially-rectangular block with a first base end 22 and a second base end 24 positioned on opposite sides of a horizontal central axis 53 centered between lateral faces 138*a* & 138*b*, 148*a* & 148*b* of clamping members 130, 140, respectively (lateral faces 138*b* and 148*b* are not visible). Base 20 provides a common element to which the other components of knife sharpener 10 are joined. In one embodiment, a middle region 26 of base 20 arches upward above first end 22 and second end 24. Middle region 26 has an optional upper slot 28 sized and configured to accept riser block 70. Optionally, riser block 70 is omitted and upper slot 28 accepts clamping members 130, 140. Upper slot 28 provides additional stability to sharpener 10 by preventing movement of riser block 70 and clamping members 130, 140 towards either of first base end 22 or second base end 24. Middle region also optionally has a lower slot or channel 30 sized and configured to accept base rod 50. Base 20 preferably has sufficient size and mass to provide a stable foundation for using knife sharpener 10. It is contemplated that base 20 may be a flat sheet of stone, a work bench, a metal block, or other suitable object with a flat surface and that provides a stable mounting platform to which components of knife sharpener 10 are attached. When base 20 is a slab of stone, for example, it has a slot to accept base rod 50 or has feet or other feature that allow sufficient space for base rod 50 to pass below base 20. In yet other embodiments, base rod 50 is attached to a top surface of base 20 and extends through a slot (not shown) in riser block 70.

Base rod 50 preferably has a square or rectangular cross-sectional profile and extends longitudinally along central axis 53 from a first end 51*a* to a second end 51*b*. Other cross-sectional geometries are also acceptable, depending on the method used to attach and adjust other components of angle adjustment assembly 170. In one embodiment, base rod 50 has a plurality of detents or recesses 52 along its length. Detents 52 are preferably in a side face 54 of base rod 50. Detents 52 allow the user to fix a bracket 172 or other connector at any one of several pre-determined locations. In one embodiment, base rod 50 has distance markings 56 to indicate the distance 165 between a reference point 58, such as the center point of base rod 50, and a proximal end of guide rod 160, which is discussed below. In one embodiment, each detent 52 corresponds to a change of one degree in a contact angle 166 between sharpening block 210 and cutting implement 8.

Base rod 50 is preferably secured to base 20 along central axis 53 and oriented perpendicularly to a vertical plane 167 extending through cutting implement 8 (shown in FIG. 2) held between clamping members 130, 140. As shown in FIG. 1, for example, base rod 50 is affixed to the underside of base 20 within lower slot 30 that runs across the width of base 20.

Riser block 70 is an optional accessory for sharpener 10 that raises clamping members higher above base 20 to achieve a smaller contact angle 166 between sharpening block 210 and cutting implement 8. Riser block 70 in one embodiment has an upper riser slot 72 that is sized and configured to accept clamping members 130, 140. Riser block also has a lower riser shoulder 74 sized and configured to fit into upper slot 28 of base 20. Upper riser slot 72 and lower riser shoulder 74 provide stability to sharpener 10 by preventing movement between adjacent components.

In one embodiment, first clamping member 130 and second clamping member 140 are each wedge-shaped blocks with respective bottom surfaces 135, 145, sloping outer surfaces 136, 146, vertical inner surfaces 137, 147, bottom portions 132, 142, top portions 139, 149, and two lateral surfaces 138*a*, 138*b*, 148*a*, 148*b*. Preferably, first and second clamping members 130, 140 have the cross-sectional shape of a right triangle with an angle in a range of about five to fifteen degrees between sloping outer surfaces 136, 146 and vertical inner surfaces 137, 147, respectively. Having a wedge shape provides top portions 139, 149 with smaller profiles than the profiles of bottom portions 132, 142. The smaller profiles at top portions 139, 149 allows sharpener 10 to be used to sharpen very small cutting implements since having thicker top portions 139, 149 would impede sharpening blocks 210 from approaching and being applied to a cutting edge located relatively close to top portions 139, 149 of clamping members 130, 140. Other configurations of first and second clamping members 130, 140 are also acceptable, such as an L-shaped bracket. In one embodiment, first and second clamping members are sized and shaped to permit a contact angle 166 below ten degrees and as small as five degrees.

In one embodiment, one or more apertures 134 extend through or partially through clamping members 130, 140. Clamping fasteners 150 extend horizontally through apertures 134 in first clamping member 130 and into apertures 144 (not visible) of second clamping member 140. Clamping fasteners 150 extend into and engage second clamping member 140 to fasten second clamping member 140 to first clamping member 130. Clamping fasteners 150 and first and second fasteners 208, 209 preferably are threaded machine screws, bolts, or the like. By tightening clamping fasteners 150, second clamping member 140 is drawn towards first clamping member 130 to engage cutting implement 8 and securely hold it in place with its blade in a vertical plane 167 (shown in FIGS. 2 & 3).

Still referring to FIG. 1, a plurality of apertures 134, 144 may be used at different vertical positions along clamping members 130, 140 to adjust the gap 307 (shown in FIG. 6) and angle between vertical surfaces 137, 147.

First clamping member 130 and second clamping member 140 are supported by riser block 70 with bottom surfaces 135, 145 positioned in upper riser slot 72 of base 20. If riser block 70 is not used, lower surfaces 135, 145 of clamping members 130, 140, respectively, are supported by base 20 and preferably positioned in an upper slot 28 of base 20.

Clamping members 130, 140 optionally include depth control apertures 154. Cutting implement 8 may be supported between clamping members 130, 140 on horizontal posts (not shown) that extend through depth control apertures 154. In this manner, cutting implement 8 is secured at a consistent vertical position between clamping members 130, 140 for each sharpening session. Clamping members 130, 140 are then drawn together by tightening clamping fasteners 150.

Alternate embodiments may use different systems for controlling the depth of cutting implement 8 between clamping members 130, 140. One example (not depicted) is a slidable shoulder located between clamping members 130, 140 that slides up and down. In one embodiment, slidable shoulder is a fulcrum block 304 that slides up and down clamping member 140 along a channel 330 in inside vertical face 140*a* (shown in FIG. 9 and discussed below).

One or more guide rods 160 are pivotably connected to base rod 50 or to base 20. Guide rods 160 are preferably rigid cylindrical rods made of metal with a proximal end 162 positioned towards base rod 50 and a distal end 164 extending above base 20. In one embodiment, proximal end 162 of one guide rod 160 is positioned towards a first end 51*a* of base rod 50 and a proximal end 162 of a second guide rod 160 (not shown) is mounted towards a second end 51*b* of base rod 50. The position of first guide rod(s) 160 relative to vertical plane 167 is preferably adjustable along base rod 50 or on base 20. Other shapes and materials of guide rod(s) 160 are acceptable provided that guide rod(s) 160 have the rigidity, strength, and other physical characteristics to deliver the desired level of precision positioning and adjustment.

Angle adjustment assembly 170 allows guide rod 160, and thus sharpening block 210, to move both parallel and perpendicular to a vertical plane 167 through cutting implement 8 (shown in FIGS. 2-3) to allow sharpening block 210 to continuously contact the cutting edge 9 of cutting implement 8. In one embodiment, angle adjustment assembly 170 connects guide rods 160 to base 20 with base rod 50. Contact angle 166 between sharpening block 210 and vertical plane 167 can be adjusted based on the position of bracket 172 along base rod 50 or on base 20. Angle adjustment assembly 170 enables the user to adjust a distance 165 between proximate end 162 of guide rod 160 and a reference point 58. For example, reference point 58 may correspond to the center of base rod 50 or to the horizontal position along base rod 50 of vertical plane 167 extending through cutting implement 8. By adjusting distance 165, contact angle 166 is defined between abrasive element holder 200 (and attached sharpening block 210) and cutting implement or vertical plane 167. Contact angle 166 may also correspond to the angle between guide rod 160 and vertical plane 167.

An abrasive element holder 200 is configured to slide along guide rod 160 via holder aperture 212 that extends through abrasive element holder 200 from end to end. Sharpening block 210 is removably attached to abrasive element holder 200, which is slidably mounted on guide rod 160. In one embodiment, abrasive element holder 200 has a substantially rectangular cross-sectional shape, therefore including four holder sides 200*a*, 200*b*, 200*c* (not visible). A sharpening block 210 with a grinding or honing material is affixed to one or more of holder sides 200*a*, 200*b*, 200*c*, 200*d*. When using multiple sharpening blocks 210, for example one on each side 200*a*-200*d*, abrasive element holder 200 may be rotated about guide rod 160 to select a honing material with the desired grit. Grinding or honing material may take any of a number of forms. Such honing material typically ranges from a coarse grit to a fine grit (for example, 80 to 1000 grit) and multiple honing materials are used in successive iterations during the sharpening process to achieve the desired sharpening effect.

In one embodiment, sharpening block 210 comprises a strap of leather or a synthetic material that is embedded with a diamond paste or other abrasive or polishing compounds. Similarly, diamond or polishing paste may be applied to the strap. Abrasive element holder 200 optionally has hand or finger depressions along opposite sides (e.g., 200*a*, 200*c*) that provide an ergonomic benefit as well as a functional benefit of protecting the user's fingers from the cutting edge 9 (shown in FIG. 3) of cutting implement 8.

In one embodiment, knife sharpener 10 includes an inclinometer 220. In one embodiment, inclinometer 220 has a digital display 221 and is affixed to or built into abrasive element holder 200. For example, in place of sharpening block 210 on holder side 200*d*, inclinometer 220 is removably attached using magnets, fasteners, hook-and-loop fasteners, clips, adhesive, or the like. As another example, components of inclinometer 200 (e.g., battery, digital display 221, electronics) are included in abrasive element holder 200 with digital display 221 along holder side 200*a*. Inclinometer 200 may alternately be affixed to abrasive element holder 200 using a frame 222 that supports inclinometer 220 around its perimeter. For example, frame 222 is configured to be inserted into guide slots (not shown) along abrasive element holder 200 or attach to abrasive element holder 200 using methods described above. An example of one acceptable inclinometer is the iGaging digital AngleCube, which measures an angle with respect to a reference surface (e.g., vertical surface 137) with an accuracy of +/−0.2 degree, precision of 0.1 degree, and resolution of 0.05 degree. Inclinometer 220 is useful to measure contact angle 166 between sharpening block 210 and cutting implement 8.

Figure 2:
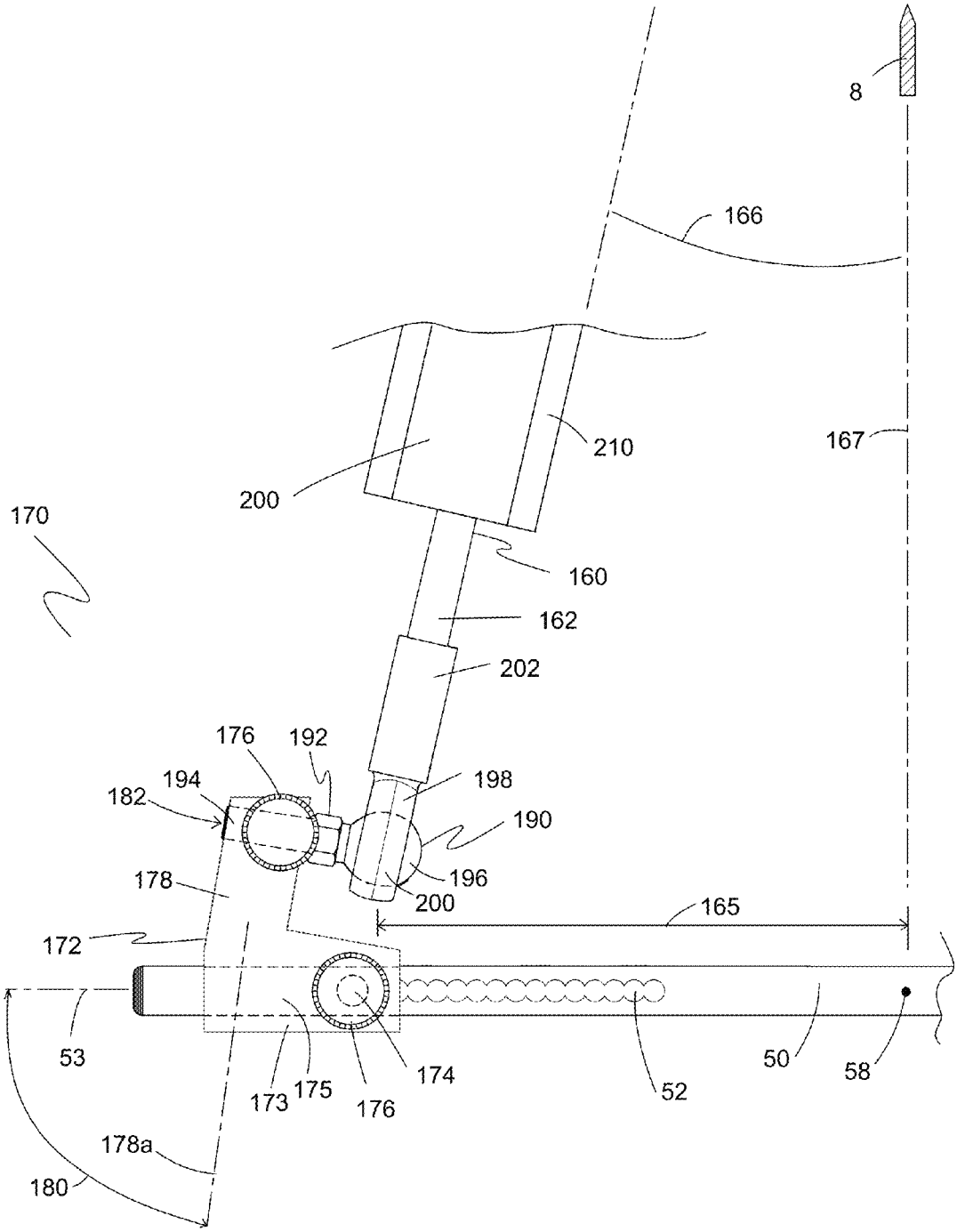
FIG. 2 is an enlarged side view of one embodiment of an angle adjustment assembly showing a guide rod pivotably connected to a base rod.

Referring now to FIG. 2, a side view is shown of one embodiment of angle adjustment assembly 170 of the embodiment of FIG. 1. Angle adjustment assembly 170 includes base rod 50, a bracket 172 adjustably mounted to base rod 50, and a universal or pivot joint 190 connected to bracket 172. Bracket 172 is preferably an L-shaped bracket with a horizontal portion 173 and an upright portion 178. Other shapes for bracket 172 are also acceptable where bracket 172 is configured to slidingly engage base 20 or base rod 50 and attach to universal joint 190. Horizontal portion 173 has a first channel or first opening 175 extending longitudinally therethrough. First opening 175 is sized and configured to receive base rod 50 for sliding movement of bracket 172 along base rod 50. A first adjustment opening 174 (preferably threaded) extends transversely through horizontal portion 173 of bracket 172. First adjustment opening 174 preferably extends transversely through first opening 175 and aligns with detents 52 along base rod 50. A threaded set screw 176, spring-biased pin, or the like extends through first adjustment opening 174 to engage detents 52 of base rod 50 and securely hold pivot joint 190 in a fixed position along length of base rod 50.

In other embodiments of knife sharpener 10, bracket 172 slides along a channel or track in or on base 20. For example, horizontal portion 173 of bracket 172 includes a flange that mates with a channel recessed into base 20.

Upright portion 178 extends upwardly from horizontal portion 173, along an upright axis 178*a* preferably oriented at an angle 180 of between seventy-five and eighty-five degrees to central axis 53. Angle 180 is not limited to these values. Upright portion 178 has a transverse second opening 182 extending therethrough, preferably perpendicular to upright axis 178*a* and aligned in the same general direction of base rod 50. Second opening 182 is preferably threaded and accepts a stem portion 194 of pivot joint 190.

In one embodiment, pivot joint 190 is a ball-and-socket joint, universal joint, coupling, or the like that permits proximal end 162 of guide rod 160 to pivot freely in any direction. When pivot joint 190 is a ball-and-socket joint, a first part 192 of pivot joint 190 has a stem portion 194 that is received in second opening 182 of bracket 172 and terminates in a sphere or ball 196 at its opposite end. A second part 198 has a socket portion 200 at one end with an opening that receives ball 196. Second part 198 has a rod connector 202 opposite of socket portion 200 to attach proximal end 162 of guide rod 160. Rod connector 202 may be a hollow cylindrical sleeve, a threaded rod, a coupler, or other connector shaped and configured to accept and retain proximal end 162 of guide rod 160.

By advancing threaded stem portion 194 into or out of second opening 182, proximal end 162 of guide rod 160 moves closer or farther away from vertical plane 167. Thus, the user may finely and precisely adjust contact angle 166 between sharpening block 210 and vertical plane 167. Preferably, stem portion 194 is threaded and has a hexagonal recess in one end to receive hex-wrenches for adjusting the position of stem portion 194 relative to vertical plane 167. In one embodiment, a 180° turn of threaded stem portion 194 advances pivot joint 190 towards or away from vertical plane 167 to cause a change in contact angle 166 of about 0.5° between sharpening block and cutting implement 8. By rotating stem portion 194 in smaller increments (e.g., 5°, 10°, or 15°) the user may achieve highly precise adjustment of contact angle 166. The position of stem portion 194 may be fixed by tightening a set screw 176 extending transversely through upright portion 178 and contacting stem portion 194. In other embodiments, second opening 182 is not threaded and receives a smooth stem portion 194.

Figure 3:
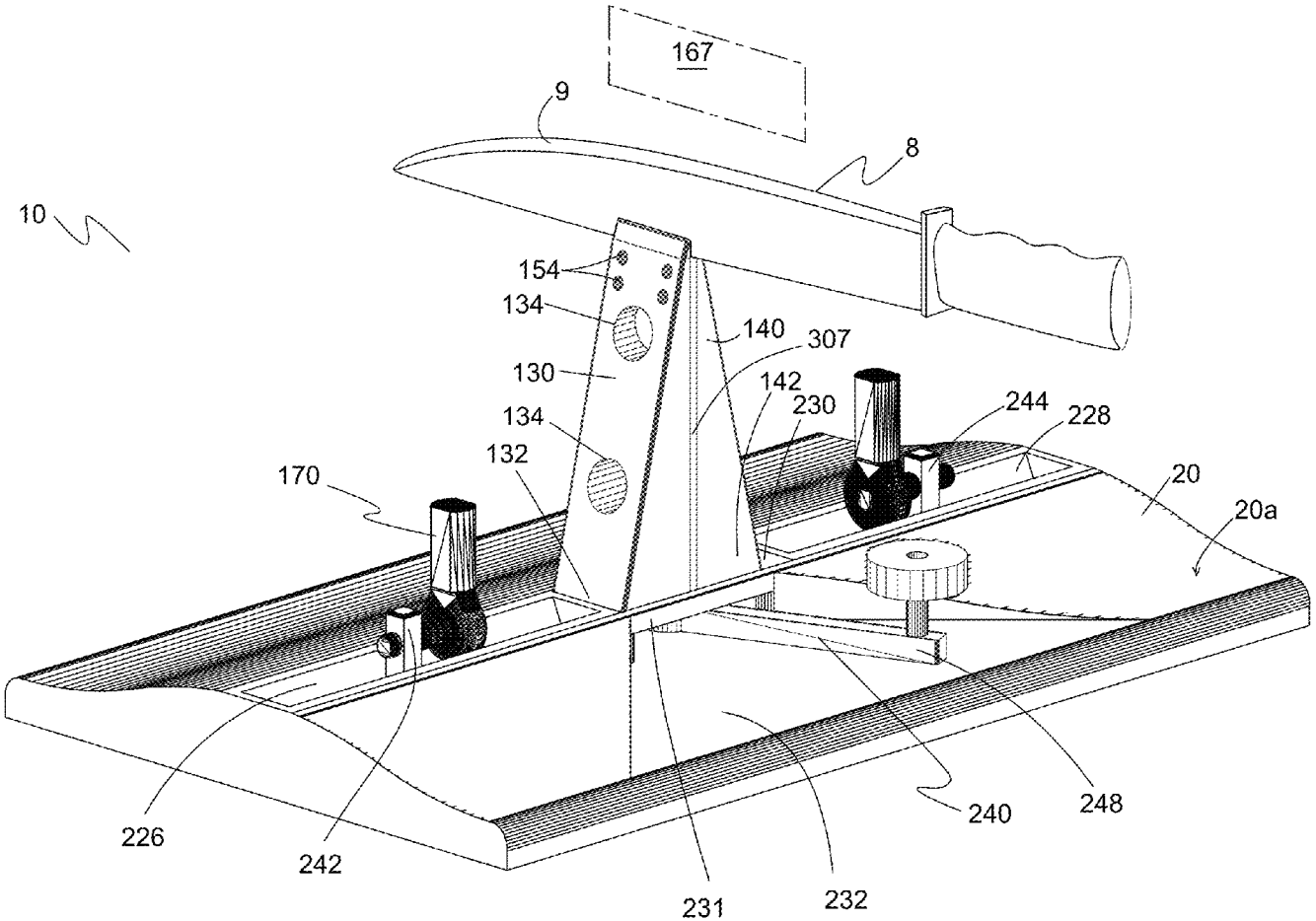
FIG. 3 is a perspective view of another embodiment of a knife sharpener of the present invention showing a knife held between first and second clamping members and one embodiment of an angle adjustment assembly.

Turning now to FIG. 3, a perspective view illustrates another embodiment of sharpener 10 with base 20, cutting implement 8 held in gap 307 between clamping members 130, 140, vertical plane 167 extending through cutting implement 8, and another embodiment of angle adjustment assembly 170 that includes a control gear 246 (shown in FIG. 4 and discussed below). For clarity of illustration, guide rods 160 and abrasive element holders 200 are not shown. Base 20 has a longitudinal first arm recess 226, a longitudinal second arm recess 228, a block recess 230, and a lever recess 232. First and second arm recesses 226, 228 are disposed in surface 20*a* of base 20 and preferably have a generally trapezoidal cross-sectional shape. First and second arm recesses 226, 228 are sized and configured to receive first and second arms 242, 244, respectively. A block recess 230 is disposed in top surface 20*a* of base 20 to accept and guide bottom portions 132, 142 of clamping members 130, 140, respectively, and defines a block bridge 231. One of clamping members 130, 140 is secured to a block bridge 231. For example, fasteners (not shown) extend vertically through block bridge 231 from below and into lower end 132 of first clamping member 130 to secure clamping member 130 to base 20. Second clamping member 140 is attached to first clamping member 130 by clamping fasteners 150 (shown in FIG. 1) that extend horizontally through clamping openings 134 in first clamping member 130 and engage second clamping member 140. Second clamping member 140 is capable of sliding horizontally within block recess 230 while being fixed to first clamping member 130 with clamping fasteners 150. First clamping member 130 may alternately be welded to base 20 or fixed using other methods.

A lever recess 232 extends through top surface 20*a* of base 20 and tunnels below block bridge 231, where lever recess 232 communicates with first arm recess 226 and second arm recess 228. First arm 242 and second arm 244 extend from first and second arm recesses 226, 228, respectively, into lever recess 232 below block bridge 231. First and second arms 242, 244 move longitudinally along first and second arm recesses 226, 228, respectively, due to engagement with a control gear 246 (not visible), which is discussed in more detail below.

Figure 4:
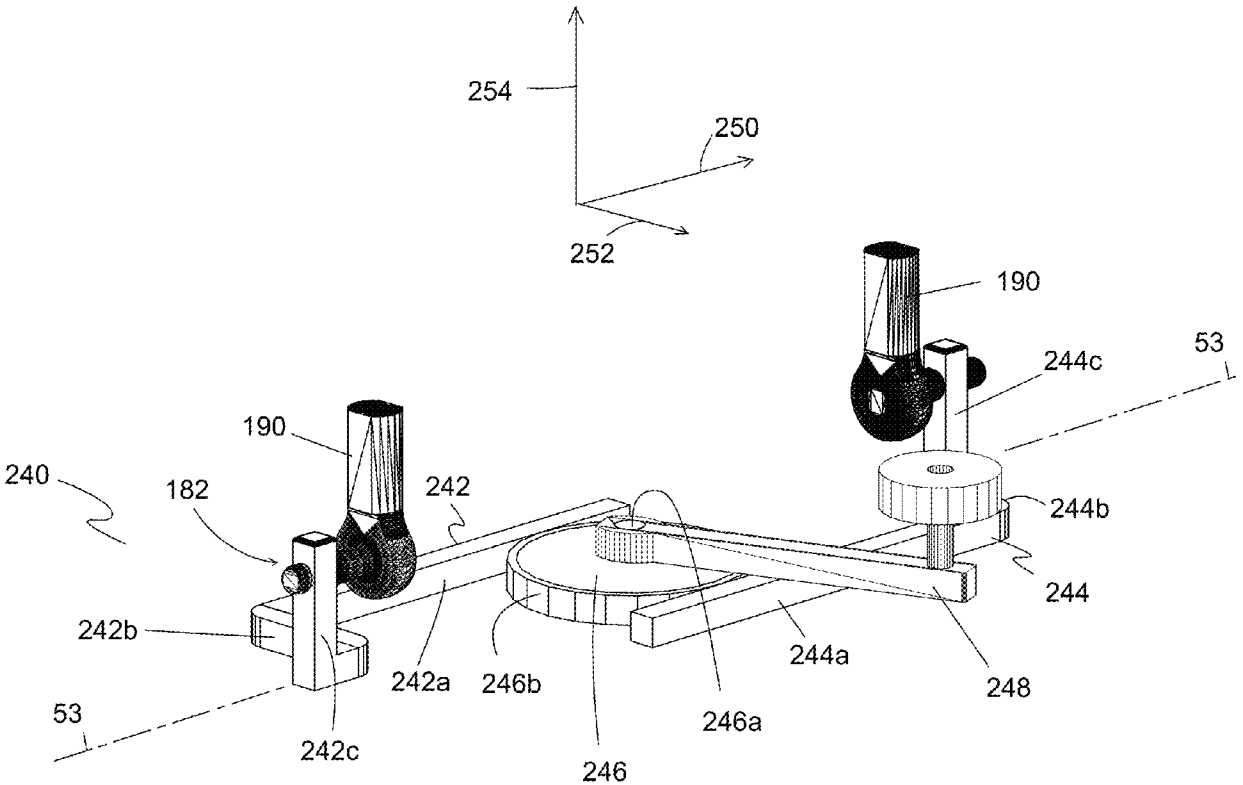
FIG. 4 is a perspective view of one embodiment of an angle adjustment assembly showing a control gear engaging first and second arms.

Referring now to FIG. 4, an embodiment is illustrated of angle adjustment assembly 240 with control gear 246. Angle adjustment assembly 240 has a first arm 242, second arm 244, control gear 246, and lever 248 fixedly attached to control gear 246. First arm 242 has a longitudinal stem portion 242*a* extending parallel to a first axis 250, a beam portion 242*b* extending from the stem portion 242*a* parallel to a second axis 252 transverse to the first axis 250, and an upright portion 242*c* extending parallel to a third axis 254 transverse to the second axis 252 and to the first axis 250. Preferably, first axis 250, second axis 252, and third axis 254 correspond to X-, Yxes, respectively. Thus, beam portion 242*b* extends in a Y-direction and defines an L with stem portion extending in an X-direction; upright portion 242*c* extends in a Z-direction and defines an L with beam portion extending in the Y-direction. Second arm is similarly configured with stem portion 244*a*, beam portion 244*b*, and upright portion 244*c*. This preferred configuration enables stem portions 242*a*, 244*a* to engage opposite sides of control gear 246 while also enabling upright portions 242*c*, 244*c* to be aligned along a central axis 53 with center 246*a* of control gear 246 and clamping members 130, 140. Upright portions 242*c*, 244*c* are each coupled to pivot joints 190 by openings 182 (preferably threaded) similar to those in brackets 172 discussed above. Other configurations of first arm 242 and second arm 244 are acceptable, preferably provided that pivot joints 190 align and move along or parallel to central axis 53 in response to engagement with control gear 246.

As the user rotates lever 248 about center 246*a* of control gear 246, control gear 246 rotates in engagement with first and second arms 242, 244, causing their longitudinal movement along central axis 53 towards or away from vertical plane 167 and clamping members 130, 140 (shown in FIG. 3). In one embodiment, control gear 146 is a toothed wheel that engages respective recesses or openings (not shown) on first and second arms 242, 244. Alternately, control gear may utilize an outer surface 246*b* having sufficient frictional engagement with first and second arms 242, 244 to cause their movement. In other embodiments, each of first and second arms 242, 244 has its own control gear 246 for independent movement of arms 242, 244.

Figure 5B:
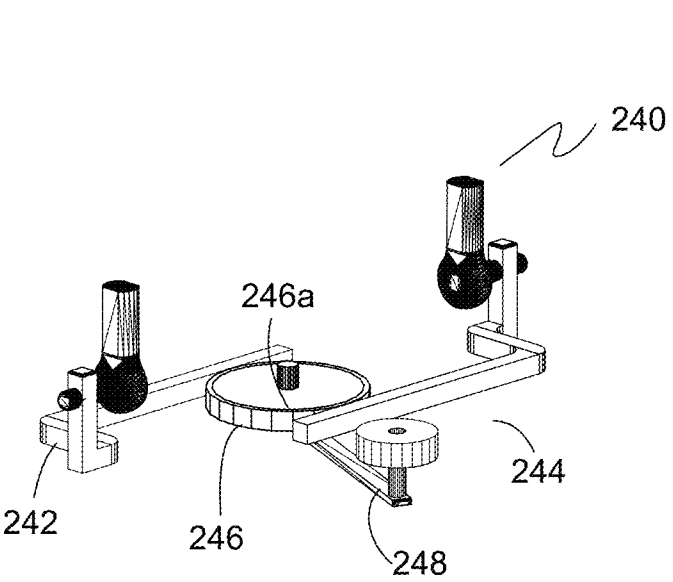
FIGS. 5A and 5B are perspective views of the angle adjustment assembly of FIG. 4 shown in a first position and a second position, respectively.
Figure 5A:
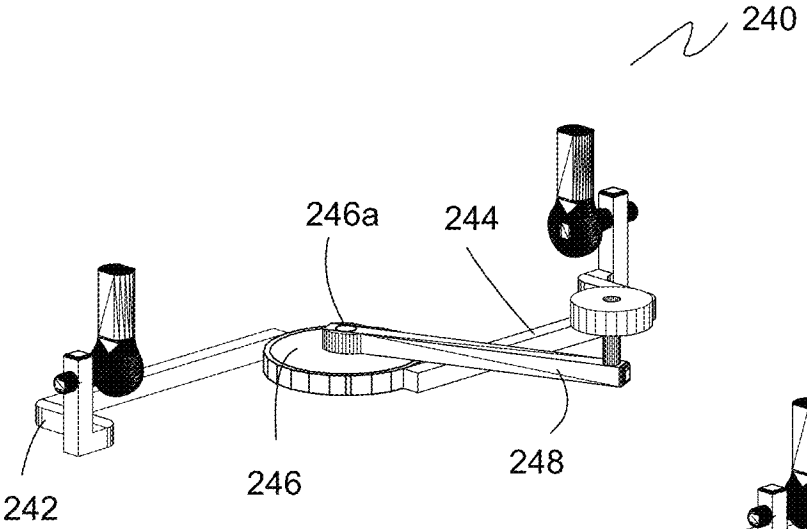

As shown in FIG. 5A, for example, an embodiment of angle adjustment assembly 240 is illustrated with lever 248 in a first position. With lever 248 in its first position, control gear 246 causes first and second arms 242, 244 to be positioned away from center 246*a* of control gear 246. Preferably, center 246*a* of control gear 246 is positioned directly below and in vertical plane 167 through cutting implement 8 (shown in FIG. 2). As shown in FIG. 5B, for example, lever 248 is in a second position, where control gear 246 causes first and second arms 242, 244 to be positioned closer to center 246*a* of control gear 246.

In one embodiment, angle adjustment assembly 240 is configured with detents, notches, or other structure on control gear 246 and/or lever 248 that indicates to the user visually, audibly, and/or tactilely that movement has occurred between each pre-determined incremental distance between pivot joints 190 and clamping members 130, 140.

Figure 6:
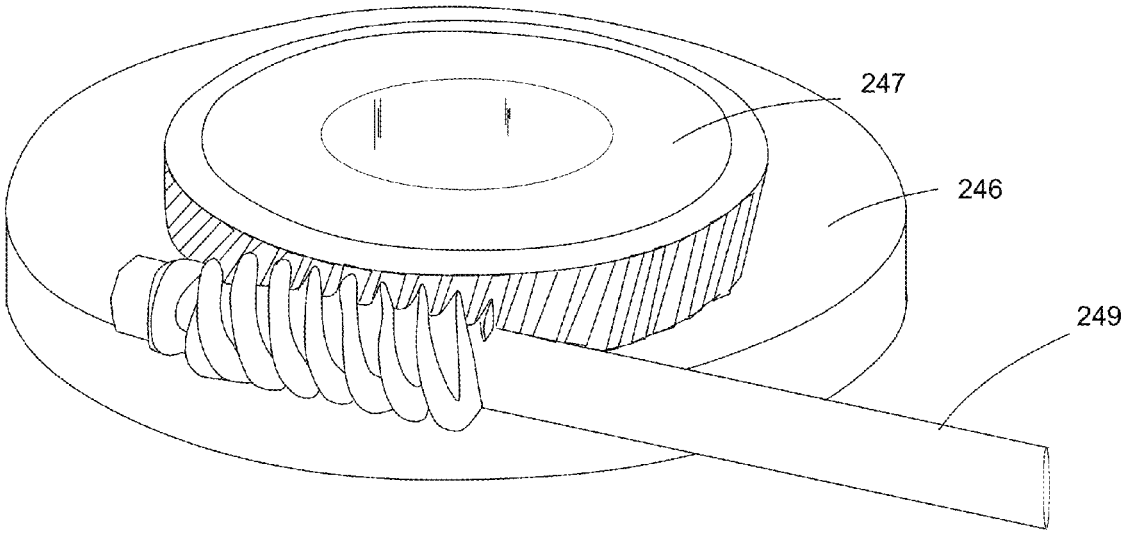
FIG. 6 is a perspective view of a worm-drive gear used with one embodiment of an angle adjustment assembly.

In other embodiments of gear assembly 240, as illustrated in FIG. 6, for example, control gear 246 is rotated by engagement between a worm-drive gear 249 and a drive gear 247. Drive gear may be attached to or formed as part of control gear 246. For example, worm-drive gear 249 and drive gear 247 are helical gears, where worm-drive gear engages drive gear 249 substantially at ninety degrees to an axis of rotation 251 of drive gear 249. In yet other embodiments, the user's hand contacts control gear 246 to rotate it. For example, control gear 246 is coupled to a second wheel or disk (not shown) that the user rotates to rotate control gear 246. Second wheel may engage control gear 246 to cause it to rotate, such as when control gear 246 and second wheel are both toothed gears. As another example, second wheel is a disk larger than control gear 246 and that extends through sharpener housing 260 instead of lever 248.

Figure 7:
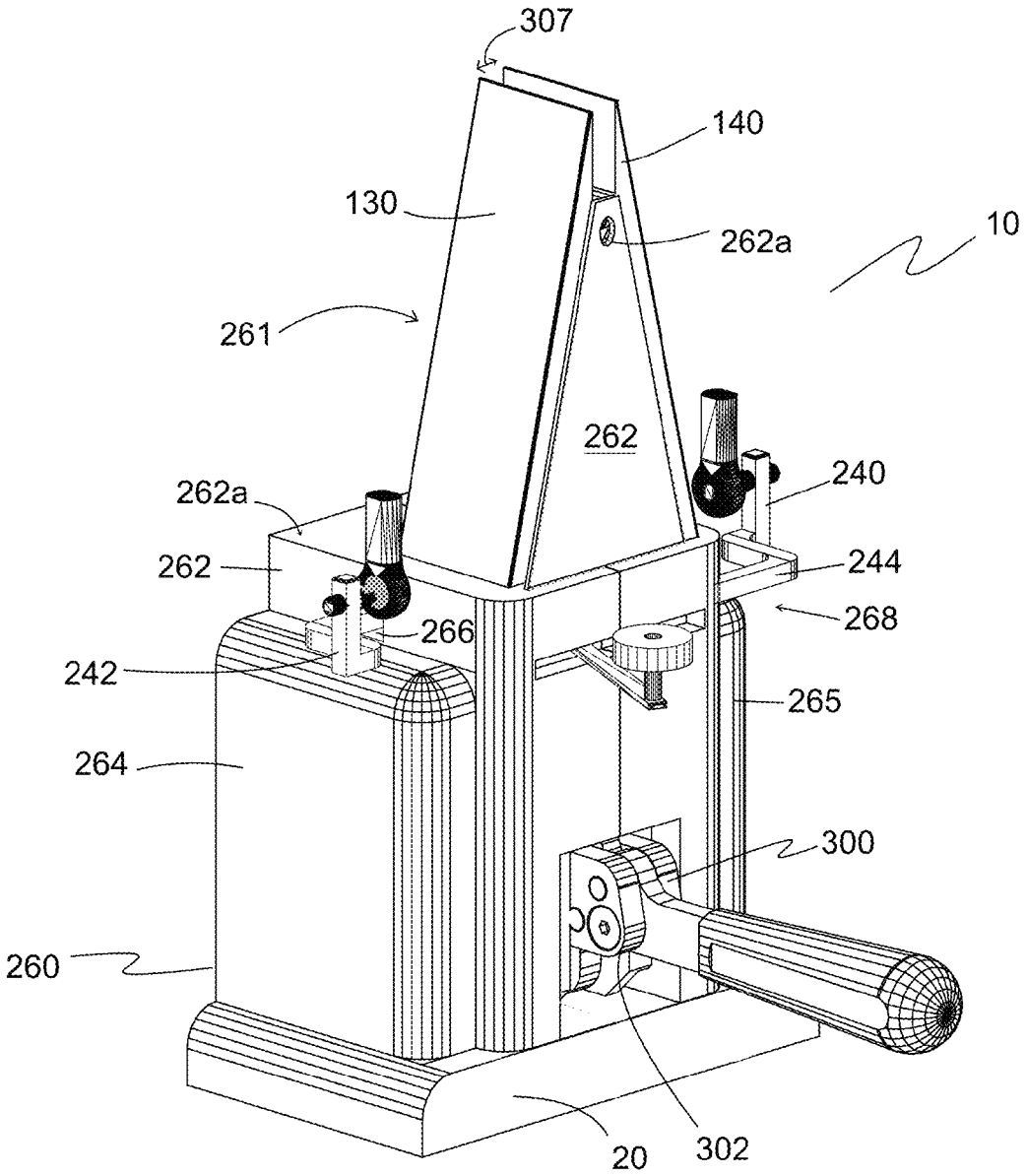
FIG. 7 is a perspective view of another embodiment of a knife sharpener of the present invention shown with a housing and embodiments of an angle adjustment assembly and a clamping assembly.

Referring now to FIG. 7, a perspective view is illustrated of another embodiment of knife sharpener 10 with base 20, angle adjustment assembly 240, sharpener housing 260, and another embodiment of clamping assembly 300 that includes first and second clamping members 130, 140 and straight-line clamp 302. Sharpener housing 260 is preferably made of metal and encloses a major portion of clamping assembly 300 and angle adjustment assembly 240. Sharpener housing 260 protects moving parts of sharpener 10 and is an extension of base 20 for attachment of components. Sharpener housing 260 optionally includes front cover plate 262 and rear cover plate 261 to partially conceal gap 307 between first and second clamping members 130, 140.

In one embodiment, front cover plate 262 and rear cover plate 261 are fixed to housing 260 and are attached to clamping members 130, 140 by a fastener, pin, rod or the like (not shown) that extends through plate opening 262*a* and fulcrum blocks 304, 306 (shown in FIG. 8 and discussed below.) Thus, clamping blocks 130, 140 have a fixed overall vertical position and have the ability to pivot, as discussed below.

In one embodiment, sharpener housing 260 has a substantially rectangular main housing body 262 with one or more side openings 263 (not visible) for access to moving parts of clamping assembly 300 and gear assembly 240. Main housing body 262 is preferably affixed to base 20 with fasteners (not shown). Side housing covers 264, 265 are preferably removably or hingedly attached to main housing body 262. Side housing covers 264, 265 are rectangular box-like covers, but may also have the form of a door or substantially planar panel. First arm 242 extends through a first arm aperture 266. Second arm 244 extends through a second arm aperture 268 (not visible). First and second clamping members 130, 140 are disposed over top opening 270 (not visible) through a top 262*a* of main housing body 262.

In one embodiment, first clamping member 130 is secured to housing and second clamping member 140 is attached to first clamping member via fulcrum blocks 304, 306 disposed connected to first and second clamping members, respectively, and discussed in more detail below. In another embodiment, riser block 70 is attached to top 262*a* of main housing body 262 and has an opening therethrough for wedge member 320. With riser block 70, first clamping member 130 is attached to riser block 70 with fasteners and second clamping member 140 is attached to first clamping member via fulcrum blocks 304, 306.

Figure 8:
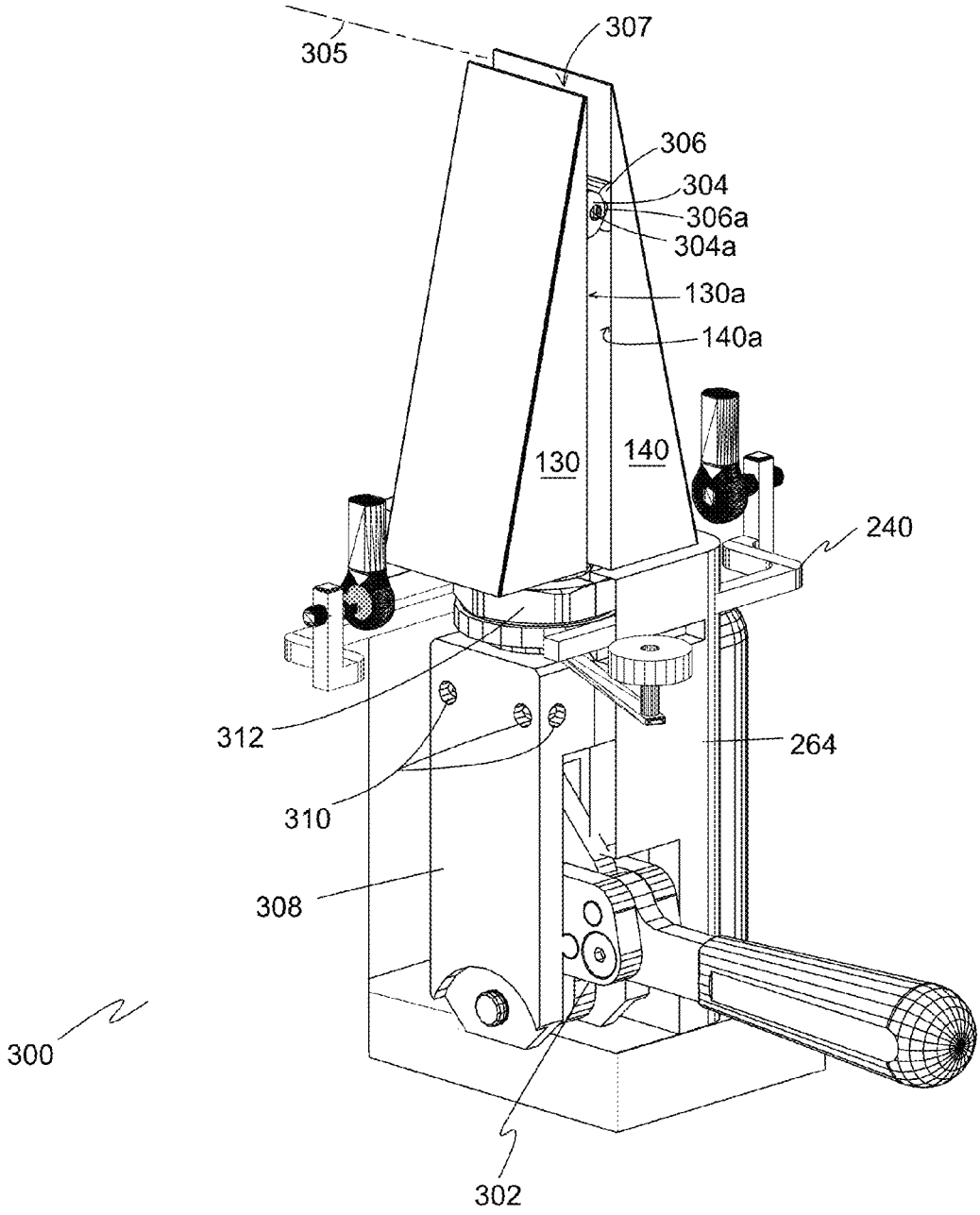
FIG. 8 is a perspective, partial cut-away view of the knife sharpener of FIG. 6 showing the clamping assembly and angle adjustment assembly.

Referring now to FIG. 8, a perspective view illustrates clamping assembly 300, angle adjustment assembly 240, and portions of housing 264. Clamping assembly 300 includes first clamping member 130, second clamping member 140, and straight-line clamp 302. One or more fulcrum blocks 304 are disposed between first clamping member 130 and second clamping member 140. In one embodiment, fulcrum block(s) 304 extends from an inside surface 130*a* of first clamping member towards second clamping member 140. Similarly, second fulcrum block(s) 306 may also extend from an inside surface 140*a* of second clamping member 140 towards first clamping member 130. In one embodiment, a single fulcrum block 304 is used. For example, fulcrum block 304 may be one or more protrusions from inside surface 130*a* of clamping member 130, such as block having a rectangular, triangular, or rounded cross-sectional profile. Fulcrum block 304 may also be distinct from or removably attached to first clamping member 130 or second clamping member 140.

In one embodiment, fulcrum blocks 304, 306 have fulcrum openings 304*a*, 306*a* that extend parallel to a central cutting implement axis 305. Fulcrum blocks 304, 306 preferably overlap or alternate with one another where fulcrum openings 304*a*, 304*b* are aligned. Like a hinge, a pin, screw, bolt, or other connector extends through openings 304*a*, 304*b* of fulcrum blocks 304, 306 so that clamping members 130, 140 pivot about openings 304*a*, 304*b*, respectively, in response to operation of straight-line clamp 302, which is discussed below. Fulcrum blocks 304, 306 preferably are shaped as solid protrusions with a rounded or semi-circular profile, but other shapes and forms are also acceptable provided that they permit clamping members 130, 140 to pivot about fulcrum block(s) 304, 306, respectively. For example, one or both of fulcrum blocks 304, 306 may be a tab, plate, or other structure that permits hinged or pivoting movement.

Fulcrum block(s) 304 and/or 306 define a gap 307 between clamping members 130, 140. Gap 307 is measured between inside surfaces 130, 140*a* when inside surfaces 130*a*, 140*a* are parallel to each other. Gap 307 is preferably adjustable using a set screw to adjust the distance that fulcrum blocks 304, 306 extend from inside surfaces 130*a*, 140*a*, respectively.

Figure 9:
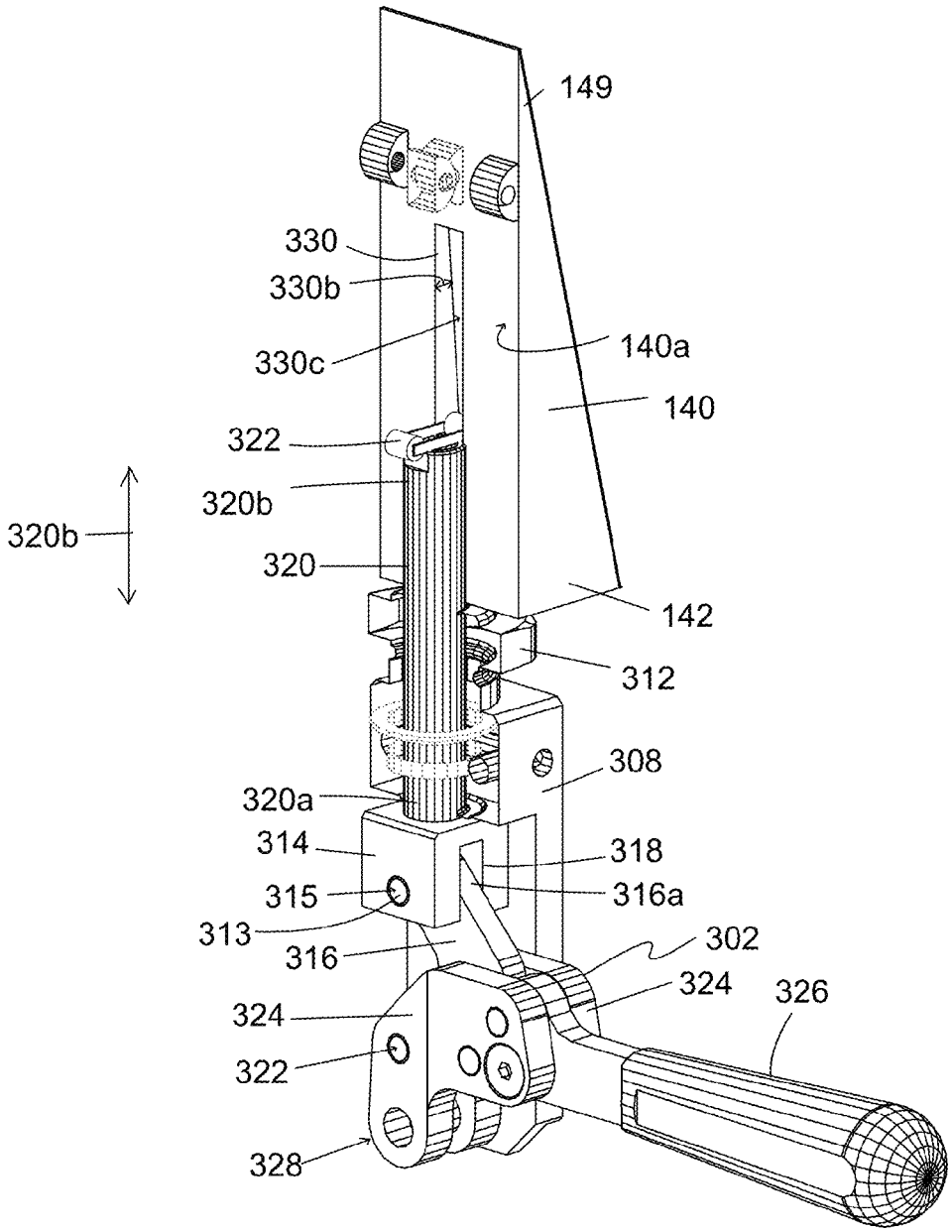
FIG. 9 is a perspective, partial cut-away view of the clamping assembly of FIG. 7 showing the wedge member and straight-line clamp.

Referring to FIGS. 8 and 9, one embodiment of straight-line clamp 302 has a clamp housing 308 that is fixedly attached to sharpener housing 260 or to another object. Only a right side portion of clamp housing 308 is shown in FIG. 9. Attachment to sharpener housing 260 may be achieved, for example, by using threaded fasteners that pass through sharpener housing 260 and engage or pass through openings 310 in straight-line clamp 302. Straight-line clamp 302 may also be secured to sharpener housing 260 by tightening nut 312 against top 262*a* of sharpener housing 260. Straight-line clamp 302 includes a wedge member block 314 attached to a wedge member 320 at a first wedge member end 320*a*. Wedge member block 314 has a slot 318 to receive L-bracket 316, which is pivotably attached at a first L end 316*a* at first pivot point 315, such as by a pin extending through wedge member block 314 and L-bracket 316. Second L end 316*b* (visible in FIGS. 10A & 10B) is pivotably attached at second pivot point 322 to elbow brackets 324. A handle 326 is fixedly attached to elbow brackets 324. Elbow brackets 324 are pivotably attached to clamp housing 308 at a third pivot point 328.

In one embodiment, at least one of clamping members 130, 140 has a slot or channel 330 along its inside surface 130*a*, 140*a* sized and configured to receive or guide second wedge member end 320*b* or an attachment thereto. As noted above, slot 300 may also be used for a sliding shoulder or fulcrum block 304. For example, engagement surfaces 332 are attached to wedge member 320 and are aligned to engage inside surfaces 330*a* of channels 330 in first and second clamping members 130, 140. Channels 330 extend into inside surfaces 130*a*, 140*a* by the distance of a channel depth 330*a* that preferably tapers from a first depth 330*a* near bottom portions 132, 140 to a second, shallower depth 330*b* towards upper portion 139, 149.

Figure 10A:
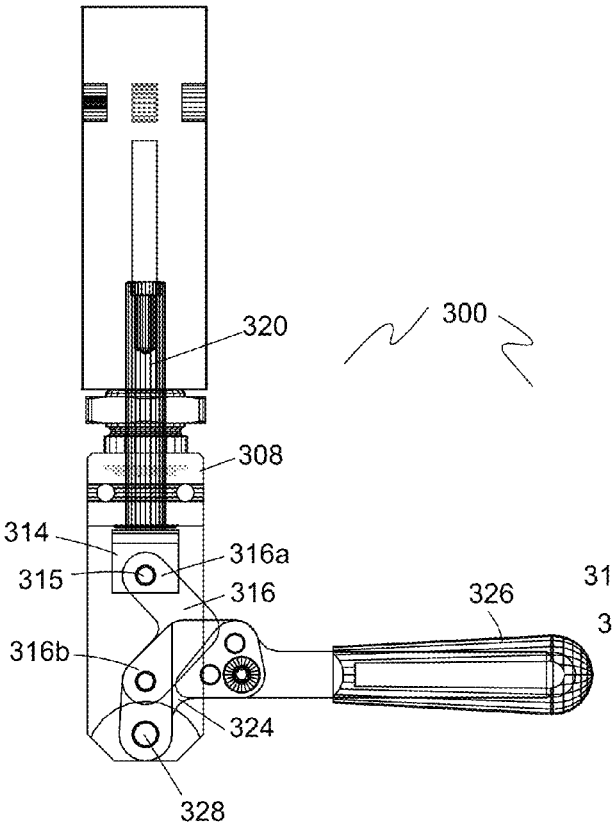
FIG. 10A is a side view showing the clamping assembly of FIG. 7 in a first position.
Figure 10B:
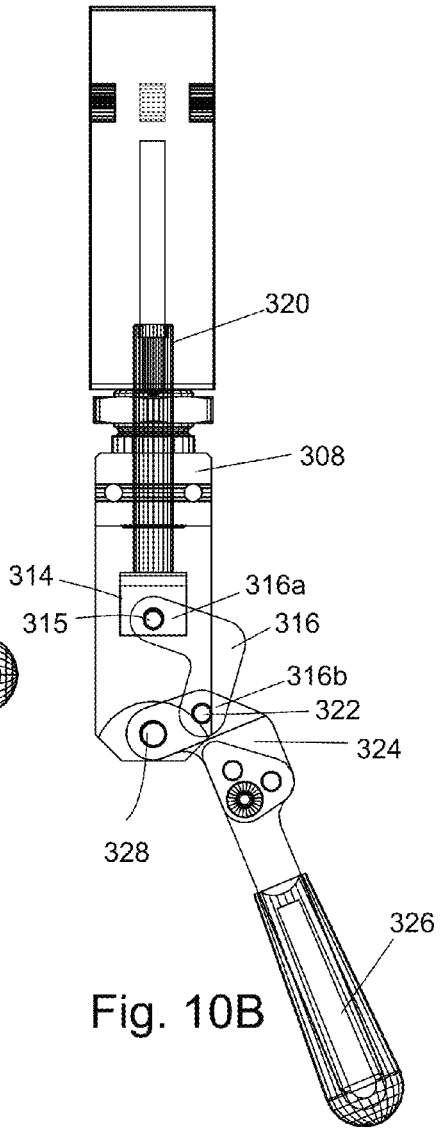
FIG. 10B is a side view showing the clamping assembly of FIG. 7 in a second position.

Referring to FIGS. 10A and 10B, side views illustrate clamping assembly 300 in a first position and a second position, respectively. As handle 326 is moved from a first position (shown in FIG. 10A) to a second position (shown in FIG. 10B), elbow brackets 324 rotate about third pivot point 328, causing second L end 316*b* of L-bracket 316 to move forward and draw wedge member block 314 and wedge member 320 vertically downward. In one embodiment, by moving handle 326 between first position and second position, second wedge member end 320*b* changes in vertical position by about 0.75 inch. While FIG. 10A shows a downward movement of handle 326 moves wedge member vertically downward, clamping assembly can be configured where an upward movement of handle 326 moves wedge member vertically downward.

Although wedge member 320 is shown in the figures as having a cylindrical shape, wedge member 320 may also be a wedge, bar, block, or other shape that is configured to increasingly separate bottom portions 132, 142 of first and second clamping members 130, 140, respectively, as wedge member 320 advances upwardly or otherwise between them. In one embodiment, second wedge member end 320*b* has engaging surface(s) 322, such as a roller, block, shoulder, protrusion, or other geometry that is shaped and configured to slidably engage or roll along inside surfaces 130*a*, 140*a* of clamping members 130, 140, respectively. As wedge member 320 moves upward between clamping members 130, 140, bottom portions 132, 142 of clamping members 130, 140 are forced apart. Clamping members 130, 140 pivot about fulcrum block(s) 304 causing top portions 139, 149 of clamping members 130, 140 to move towards each other. Thus, when cutting implement 8 is positioned between clamping members 130, 140, handle 326 is moved to its first position to cause top portions 139, 149 to firmly engage cutting implement 8 and securely hold it in place for sharpening.

In other embodiments of clamping assembly 300, wedge member 320 has gears or threads. Wedge member 320 may alternately be advanced upward between first and second clamping members 130, 140 by engagement between a worm drive and gear or threads on wedge member 320. In other embodiments, the end of a lever or bar may be positioned between bottom portions 132, 142 of clamping members 130, 140 and its opposite end moved sideways to increase or decrease gap 307 between bottom portions 132, 142 of first and second clamping members, respectively. In such an embodiment, bottom portions 132, 142 are preferably biased towards each other with a spring, piston, gravitational force, or other means.

Figure 11:
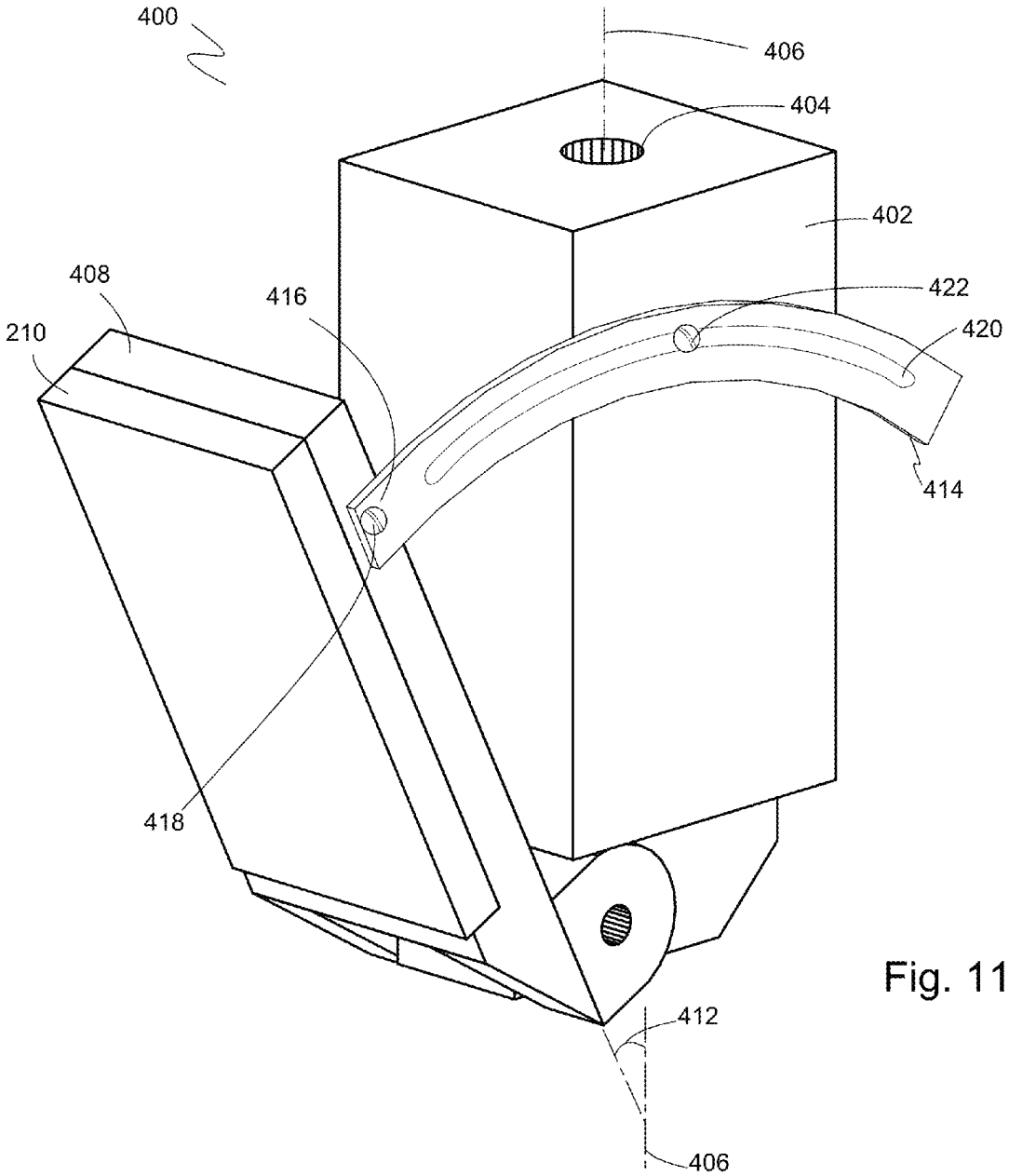
FIG. 11 is a perspective view of one embodiment of an abrasive element holder with adjustable face plate.

Referring now to FIG. 11, a perspective view illustrates another embodiment of abrasive element holder 400 with a body 402, an adjustable face plate 408, and a holder aperture 404 that extends along a guide rod axis 406. Adjustable face plate 408 is hingedly or pivotably attached to body 402 of abrasive element holder 400. Adjustable face plate defines a second stone angle 412 with guide rod axis 406. Adjustable face plate 408 is preferably a substantially planar rectangular plate that is configured to receive sharpening block 210. Sharpening block 210 is removably attached to adjustable face plate 408 similar to attachment methods described above for abrasive element holder 200.

A second stone angle 412 may be set and adjusted between adjustable face plate 408 and guide rod axis 406. Abrasive element holder 400 optionally has an angle guide 414 attached between adjustable face plate 408 and slidably attached to body 402 of abrasive element holder 400. In one embodiment, angle guide 414 is fixed at one end 416 to adjustable face plate 408 with a fastener 418. Angle guide 414 has a slot 420 and fastener 422 extending into body 402 for slidable adjustment of second stone angle 412. Fastener 422 may be tightened against angle guide 414 to "lock in" second stone angle 412. Notches (not shown) along angle guide may similarly be used to adjust and lock in second stone angle 412, where a notch is hooked over fastener 422 or other protrusion from body 402. In other embodiments, adjustable face plate 408 is adjusted by moving a threaded rod or fastener (not shown) forward or backward between body 402 and adjustable face plate 408.

Figure 12A:
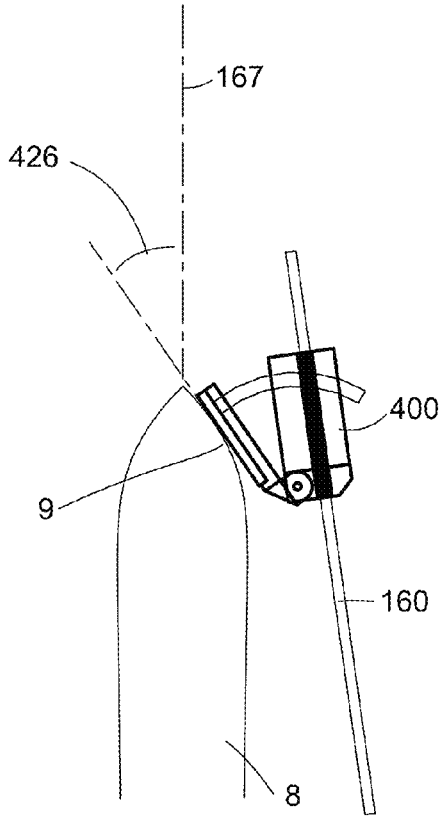
FIG. 12A is a side view of the abrasive element holder of FIG. 10 engaging the cutting surface of a cutting implement at a first position along the guide rod.
Figure 12B:
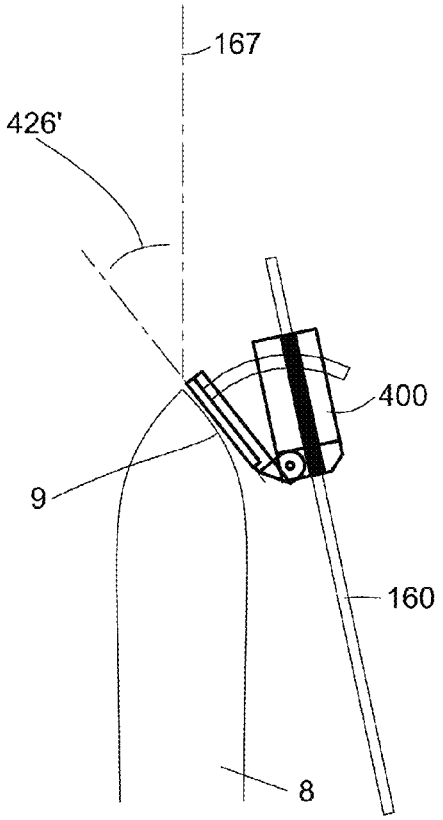
FIG. 12B is a side view of the abrasive element holder of FIG. 10 engaging the cutting surface of a cutting implement at a second position along the guide rod.

Referring now to FIGS. 12A and 12B, abrasive element holder 400 enables the user to precisely sharpen cutting implements 8 having a curved cutting edge 9 as is found on sport knives, barber's shears, and other cutting implements. As the user slides abrasive element holder 400 up and down guide rod 160, angle 426 changes between sharpening block 210 and vertical plane 167 through cutting implement 8. As shown, abrasive element holder 400 in FIG. 12A is at a lower position on guide rod 160 than in FIG. 12B. As a result, angle 426 is smaller than angle 426'. Using this approach, cutting implements 8 with curved cutting edges 9 can be precisely sharpened.

Figure 13:
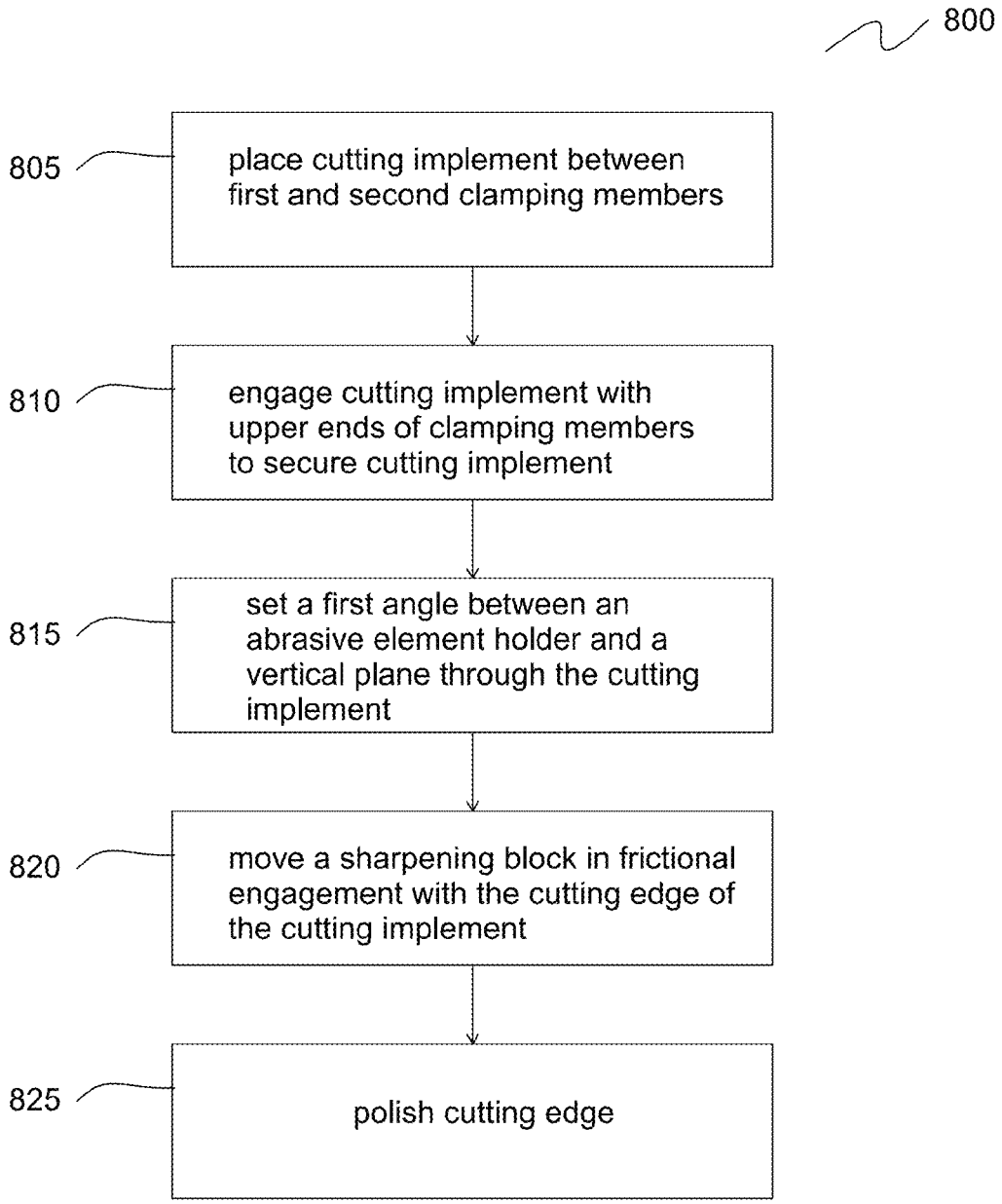
FIG. 13 is a flow chart illustrating steps in one embodiment of a method of sharpening a cutting implement.

Referring now to FIG. 13, a flow chart illustrates steps of one embodiment of a method 800 of sharpening a cutting implement 8. In step 805, a cutting implement 8 is placed between an upper end 133 of a first clamping member 130 and an upper end 143 of a second clamping member 140. In step 810, the upper ends 133, 143 of the first and second clamping members 130, 140, respectively, are drawn together to engage cutting implement 8. In one embodiment, the upper ends 133, 143 are drawn together by advancing a piston or wedge member 320 upwardly between the first and second clamping members 130, 140, thereby increasing gap 307 between lower end 132 of first clamping member 130 and lower end 142 of second clamping member 140 and causing upper ends 133, 143 of the first and second clamping members 130, 140 to engage cutting implement 8.

In step 815, if a contact angle or first angle 166 has not been set between an abrasive implement holder 200 and a vertical plane 167 through cutting implement 8, the user optionally adjusts first angle 166. First angle 166 can be set by changing the horizontal distance between proximal end 162 of guide rod 160 and vertical plane 167 through cutting implement 8. When sharpening cutting implement 8 having a curved or complex cutting edge 9, the user optionally sets a second stone angle 412 between sharpening block 210 and guide rod axis 406. Setting a second stone angle 412 may be performed by using an abrasive element holder with adjustable face plate 408 and pivoting adjustable face plate 408 with respect to body 402 and guide rod axis 406.

First angle 166 is chosen in part by the cutting edge sought and in part on the type of cutting implement to be sharpened. For example, for Japanese culinary knives, first angle is typically from about nine to about thirteen degrees and may be as small as about five or six degrees. For some knives (e.g., German culinary knives), first angle 166 may be selected to be from about fifteen to about twenty-two degrees or from fifteen to about twenty-five degrees. For sharpening sport knives (e.g., bush knives), first angle may be set from twenty-five to about thirty five degrees. For other cutting implements (e.g., salon shears), first angle may be selected to be from forty to sixty degrees or from forty to seventy degrees. These values are merely illustrative and other values for first angle 166 are acceptable. These ranges for first angle 166 are not limited to a particular cutting implement and include all angles within the range.

Similarly, second stone angle 412 is chosen in part on the type of cutting edge sought and in part on the type of cutting implement to be sharpened. In general, a larger value for second stone angle 412 results in a greater curvature of cutting edge 9. In some cases, a larger value for second stone angle 412 reduces the need for a larger value of first angle 166. Also, a larger value for second stone angle 412 tends to provide less precision for cutting edge 9. When sharpening knives, second stone angle 412 is selected, for example, from zero to forty-five degrees. When sharpening salon shears, second stone angle 412 is selected, for example, from forty-five to eighty degrees. These values for second stone angle 412 are merely illustrative and other values for second stone angle 412 are acceptable. These ranges for second stone angle 412 are not limited to a particular type of cutting implement In step 820, sharpening block 210 attached to the abrasive implement holder 200 is drawn in frictional engagement across the cutting edge 9 of cutting implement 8 by reciprocally moving sharpening block 210 upward and downward along a guide rod 160. Sharpening block 210 preferably is repeatedly drawn up and down along all or a substantial portion of the length of cutting edge 9 of cutting implement 8 as necessary to obtain the desired sharpening effect. When sharpener 10 is equipped with two sharpening blocks 210, one on each side of cutting edge 9, each sharpening block 210 may be drawn across cutting edge 9 in an alternating fashion, one at a time for a repeated number of strokes before applying the opposite sharpening block 210. The use of alternating sharpening blocks 210 has been shown to be a very efficient method of sharpening cutting implement 8. By using sharpening blocks 210 that progress from coarse grit to fine grit, the desired angle of the cutting edge 9 of cutting implement 8 is created or set.

In step 825, cutting edge 9 of cutting implement 8 is optionally polished or finished. Once the user feels a burr being created on one side of the cutting edge 9, the burr indicates that the ridge of the cutting edge 9 is rolling over and that the angle is created or set, at which point it is appropriate to begin polishing cutting edge 9 with sharpening blocks 210 of finer grit. Polishing the cutting edge 9 may also be done by using a sharpening block 210 having a leather strap embedded with a diamond paste or other abrasive. As a final polishing or finishing step, it is preferable in some embodiments of sharpening method 800 that the first angle 166 is altered by about 0.5 to 1 degree to achieve a better sharpening effect.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. An apparatus for sharpening a cutting implement held in a vertical plane comprising:

a base;

a first clamping member extending above the base and having a first vertical inside surface substantially parallel to a vertical plane of the cutting implement, a first top portion, and a first bottom portion;

a second clamping member extending above the base and having a second vertical inside surface substantially parallel to the vertical plane and facing the first vertical inside surface, a second top portion opposite the first top portion, and a second bottom portion opposite the first bottom portion, wherein the first clamping member and the second clamping member are adjustable to releasably secure a cutting implement between the first vertical inside surface and the second vertical inside surface;

at least one guide rod having a proximal end and a distal end, wherein the proximal end is pivotably attached to the base at a distance between the proximal end and the vertical plane, wherein the distal end extends above the base, and wherein the at least one guide rod defines a first angle with the vertical plane; and an abrasive implement holder configured to slidably move along the at least one guide rod and comprising:

a body having a holder aperture therethrough, wherein the holder aperture extends along a guide rod axis and is sized and configured to receive the at least one guide rod;

an adjustable face plate pivotably connected to the body and defining a second angle with the guide rod axis, wherein pivoting the adjustable face plate changes the second angle.

2. The apparatus of claim 1, further comprising:

a fulcrum disposed between the first vertical inside surface and the second vertical inside surface;

a wedge member movable between the first clamping member and the second clamping member to change the gap between first top portion and the second top portion by pivoting the first clamping member about the fulcrum with respect to the second clamping member.

3. The apparatus of claim 2, further comprising a straight-line clamp connected to the wedge member, wherein actuating the straight-line clamp moves the wedge member.

4. The apparatus of claim 2, wherein the wedge member further comprises gears for engagement with a geared rotatable shaft.

5. The apparatus of claim 2, wherein at least one of the first vertical inside surface and the second vertical inside surface defines a slot having a slot depth, the slot being sized and configured to movably engage the wedge member.

6. The apparatus of claim 1, wherein the slot depth increases towards the first bottom portion.

7. The apparatus of claim 1, further comprising an angle adjustment assembly comprising:

at least one arm connected to the proximal end of the at least one guide rod; and a control gear disposed in rotational engagement with the at least one arm;

wherein rotation of the control gear changes the distance between the proximal end and the vertical plane.

8. The apparatus of claim 7, further comprising a universal joint connected between the at least one arm and the proximal end of the at least one guide rod.

9. The apparatus of claim 1, wherein the first angle with the vertical plane is adjustable to less than ten degrees.

10. The apparatus of claim 1, further comprising an inclinometer configured to display the angle with the vertical plane.

11. The apparatus of claim 10, wherein the inclinometer is integrally attached to the abrasive implement holder.

12. A method of sharpening a cutting implement, comprising:

securing a cutting implement in a vertical plane between a first vertical inside surface of a first clamping member and a second vertical inside surface of a second clamping member, wherein the first clamping member and the second clamping member extend above a base member;

mounting a sharpening block for longitudinal sliding movement along a guide rod, the guide rod having a proximal end attached to the base member at an adjustable distance from the vertical plane, and the sharpening block having a body extending substantially parallel to the guide rod and a face plate pivotably connected to the body;

setting a first angle between a sharpening block and the fixed vertical plane by adjusting the distance of the proximal end of the guide rod from the vertical plane;

setting a second angle between the sharpening bock and the guide rod by pivoting the face plate relative to the body of the sharpening block; and moving the sharpening block up and down along the guide rod and in frictional engagement with a the cutting implement.

13. The method of claim 12, wherein the securing step includes advancing a wedge member vertically along the first vertical inside surface and the second vertical inside surface, thereby increasing a gap between a bottom portion of the first clamping member and a bottom portion of the second clamping member and causing the top portion of the first clamping member and the top portion of the second clamping member to engage the cutting implement.

14. The method according to claim 12, wherein the first angle is set between five and fifteen degrees.

15. The method according to claim 12, wherein the first angle is set between fifteen and thirty-five degrees.

16. The method according to claim 12, wherein the first angle is set between forty to seventy degrees.

17. The method according to claim 12, wherein the second angle is set between zero and forty-five degrees.

18. The method according to claim 12, wherein the second angle is set between forty-five and eighty degrees.

19. An apparatus for sharpening a cutting implement held in a vertical plane comprising:

a base;

a first clamping member extending above the base and having a first vertical inside surface substantially parallel to a vertical plane of the cutting implement, a first top portion, and a first bottom portion;

a second clamping member extending above the base and having a second vertical inside surface substantially parallel to the vertical plane and facing the first vertical inside surface, a second top portion opposite the first top portion, and a second bottom portion opposite the first bottom portion;

a fulcrum disposed between the first vertical inside surface and the second vertical inside surface;

a wedge member configured to move vertically along the first vertical inside surface of the first clamping member and the second vertical inside surface of the second clamping member to change the gap between first top portion and the second top portion by pivoting the first clamping member about the fulcrum with respect to the second clamping member;

at least one guide rod having a proximal end and a distal end, wherein the proximal end is pivotably attached to the base at a distance between the proximal end and the vertical plane, the distal end extends above the base, and the at least one guide rod defines an angle with the vertical plane; and a sharpening block configured to slidably move along the at least one guide rod.

20. The apparatus of claim 19, further comprising an angle adjustment assembly comprising:

at least one arm connected to the proximal end of the at least one guide rod; and a control gear disposed in rotational engagement with the at least one arm;

wherein rotation of the control gear changes the distance between the proximal end and the vertical plane.

21. The apparatus of claim 19, further comprising a straight-line clamp connected to the wedge member, wherein pivoting one end of a handle about a pivot point adjacent a second end of the handle of the straight-line clamp linearly advances the wedge member vertically along first vertical inside surface and the second vertical inside surface.

22. The apparatus of claim 19, wherein the wedge member comprises gears for engagement with a geared rotatable shaft.

23. The apparatus of claim 19, wherein at least one of the first vertical inside surface and the second vertical inside surface defines a slot having a slot depth, the slot being sized and configured to movably engage the wedge member.

* * * * *